United States Patent [19]

Lum

[11] 4,311,330

[45] Jan. 19, 1982

[54] DOOR LATCH

[75] Inventor: Albert C. H. Lum, Honolulu, Hi.

[73] Assignee: D.S.L. Inc., Honolulu, Hi.

[21] Appl. No.: 106,012

[22] Filed: Dec. 21, 1979

[51] Int. Cl.[3] ..... E05C 1/04

[52] U.S. Cl. ..... 292/210; 292/298

[58] Field of Search ..... 292/210, 297, 298, 296, 292/290, 291, 244

[56] References Cited

U.S. PATENT DOCUMENTS

| | | | |
|---|---|---|---|
| 800,007 | 9/1905 | Niles | 292/296 |
| 892,462 | 7/1908 | Stewart | 292/297 |
| 960,521 | 6/1910 | Early | 292/298 |
| 970,273 | 9/1910 | Sorrow | 292/297 |
| 1,065,965 | 7/1913 | Palmer et al. | 292/297 |

*Primary Examiner*—Richard E. Moore

*Attorney, Agent, or Firm*—Littlepage & Webner

[57] ABSTRACT

Ridged with a plate mounted on a door jamb is an inward extension, on the free end of which is pivoted a latch which swings between door-blocking and door-unblocking positions. The latch is releasably retained in door-blocking position by a flat strip having one end pivoted to the latch and a free end engageable between the door and the door jamb. The latch also has an intermediate position which permits the door to be cracked open.

4 Claims, 8 Drawing Figures

DOOR LATCH

FIELD OF THE INVENTION

Closure fasteners, Portable Securing Plate or Bar, Swinging holding member.

OBJECTS

The primary object of this invention is to provide a door latch which can be easily and quickly changed between latching and unlatching condition; and which, in its latching position, mechanically blocks the door against opening, and which cannot be forced to its unlatching position without positive manipulation of a latch-retaining member.

Another object is to provide a door latch of the foregoing characteristics which retains itself in an intermediate position so as to permit the door to be cracked open.

Still another object is to provide a door-blocking latch which, by selective orientation of a latch-retaining member, can be adapted to either a left-hand in-swinging door or right-hand in-swinging door.

These and other objects will be apparent from the following specification and drawings, in which.

Figure 1:
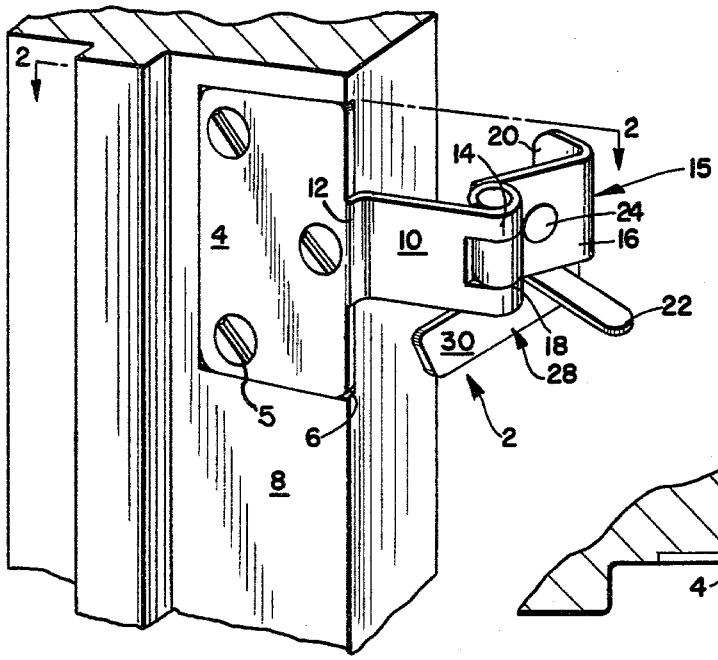
FIG. 1 is a perspective view of the latch installed on a door jamb.

Referring now to the drawings, in which like reference numerals denote similar elements, the door latch 2 is shown in FIGS. 1–7 as it is used on a right-hand in-swinging door. The latch consists of a plate 4 fastened as by screws 5, into a notch 6 so that it lies flush with the door jamb 8. Integral with plate 4 is an inward extension 10 which is offset as at 12 to provide clearance for the door 13. On the outer end 14 of extension 10 a latch 15, an arm 16 of which is pivoted as at 18 to the extension. On the free end of arm 16 is a right-angle flange 20 which, as will be explained hereinafter, is the door blocking member. An elongate tab 22, which extends in the opposite direction from flange 20, is integrally formed on arm 16.

On one side of arm 16 is a pintle 24 to which one arm 26 of a latch retainer 28 is pivoted. Retainer 28, which is an L-shape flat strip, has another arm 30 at right angles to arm 26, whose function will be apparent hereinafter. The retainer is removably retained on pintle by a spring ring 32.

Figure 2:
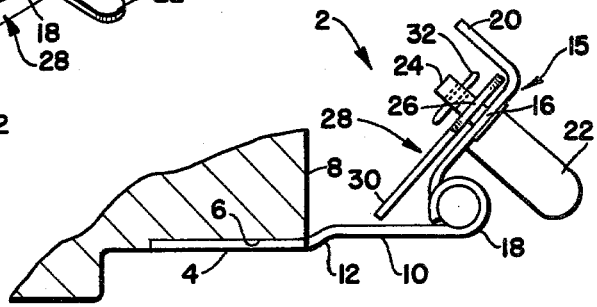
FIG. 2 is a fragmentary cross-section along the line 2—2 of FIG. 1.
Figure 3:
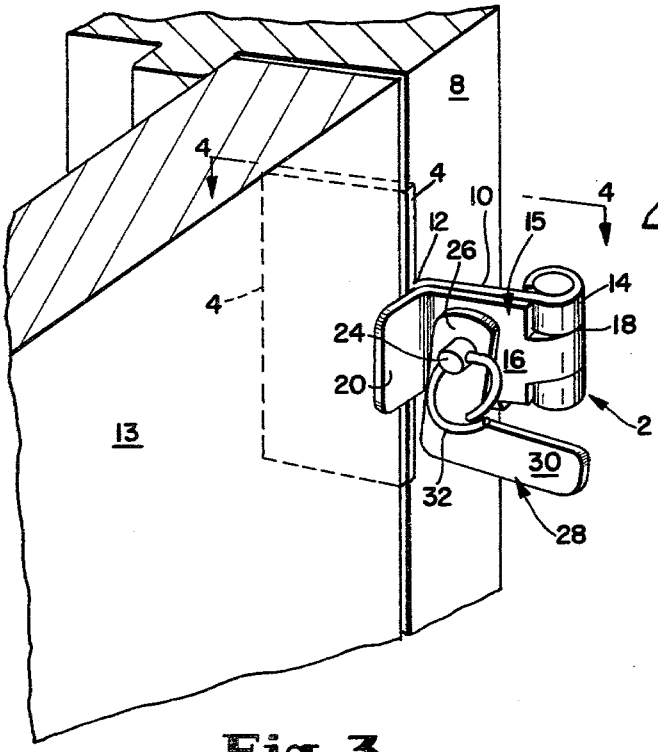
FIG. 3 is a view comparable to FIG. 1 showing the latch in door-blocking position, but with the retaining member yet to be engaged.
Figure 4:
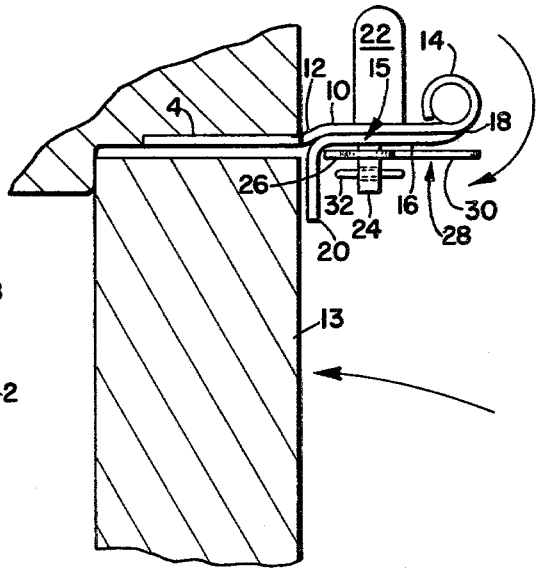
FIG. 4 is a fragmentary cross-section along the line of 4—4 of FIG. 1.
Figure 5:
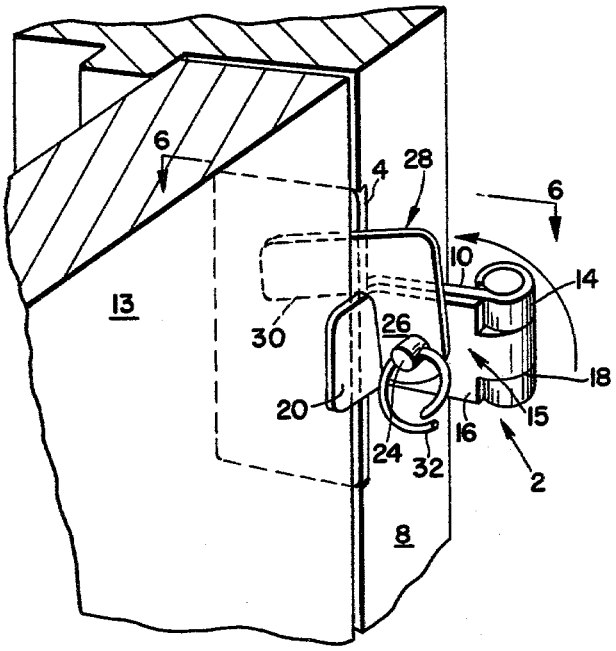
FIG. 5 is a view comparable to FIG. 3 showing the latch in door-blocking position and the retaining member engaged.
Figure 6:
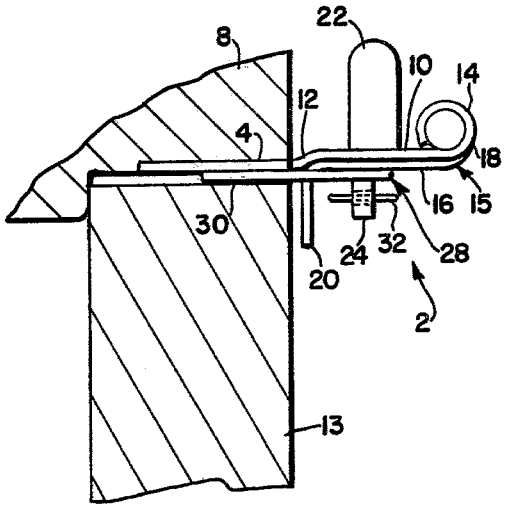
FIG. 6 is a fragmentary cross-section along the line 6—6 of FIG. 5.

In operation the latch is swung to its FIG. 1 and FIG. 2 position, door 13 is closed, and the latch 15 is swung about its pivot 18 so as to engage the flange 20 against the inner side of door 13, and in the swing path thereof. Thereafter retainer 28 is swung upwardly to its position of FIG. 5 and FIG. 6 so that its arm 30 engages between the inner edge of door 13 and plate 4. In this condition, retainer 28 holds latch 15 and prevents it from swinging. Thus the flange 20 is retained firmly in the door-blocking position of FIG. 5 and FIG. 6.

Figure 7:
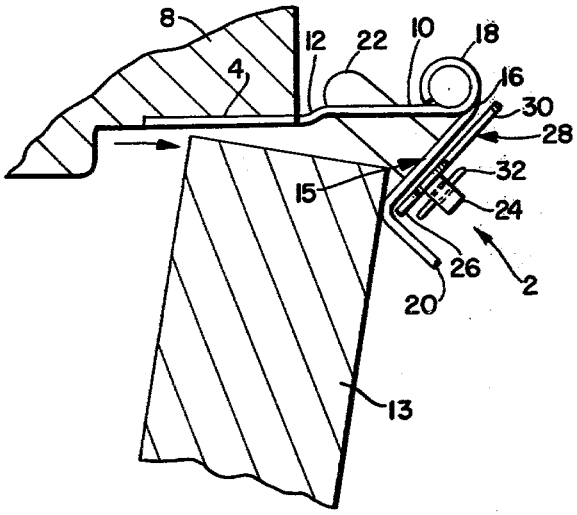
FIG. 7 shows the latch arranged for permitting partial opening of the door.

If it is desired to permit the door to be cracked open, the retainer 28 may be swung back so as to permit latch 15 to pivot slightly, and when the door is partly opened, it corner engages against arm 10 and swings it counterclockwise, as seen in FIG. 7, for about 45°, but it cannot swing it further because the door corner is trapped betweeb tab 22 and flange 20. Hence, the door is blocked against opening further inwardly from its cracked position until the door is re-closed and the latch is swung clear from the swing path of the door as in FIG. 1.

Figure 8:
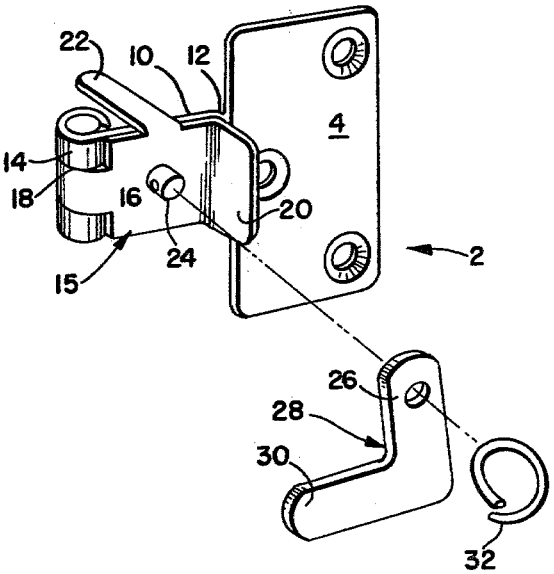
FIG. 8 is an exploded view illustrating the adaptability of the latch for a left-hand in-swinging door.

If the latch is to be used for a left-hand in-swinging door, spring ring 32 is removed from pintle 24, retainer 28 is reversely oriented to the position illustrated in FIG. 8, and the assembly is inverted so as to place the tab 22 on the upper side of arm 10.

I claim:

1. A door latch, comprising:

a mounting plate adapted to be secured against the frame of an inwardly-opening door and an extension adapted to extend inwardly away from the door frame, a latch comprising an arm having one end pivoted to the mounting plate extension and a flange on the opposite end thereof, said latch being pivotal between a normal door-blocking position in which said arm lies adjacent said plate extension and said flange is disposed in the swing path of the door, and a door-unblocking position in which said flange lies clear of the swing path of the door, and a latch retainer comprising a flat strip having one end pivoted to said arm and means on another end for engaging between the door edge and the door frame for preventing pivotal movement of the latch from its door blocking position, said latch retainer being substantially L-shape, said one end thereof being one leg of the L and the mounting thereof on said latch arm being a pivot, the other end of the latch retainer being the other leg of the L, the latch arm and flange being of flat plate material and the flange extending at substantially 90° with respect to the latch arm, said latch also including an integral tab extending at substantially 90° with respect to the other side of said latch arm, whereby when said other end of said latch retainer is disengaged from between said door edge and door jamb, the door may be cracked open so as to swing said latch arm away from its normal door-blocking position until said tab engages the end edge of said door.

2. A door latch as claimed in claim 1, said tab being integral with one edge of said latch arm.

3. A door latch as claimed in claim 2, and means for releasably retaining said latch leg on said pintle whereby the orientation of the other leg of the latch retainer may be reversed to accomodate the latch to either a left-hand or a right-hand door.

4. A door latch, comprising:

a mounting plate adapted to be secured against the frame of an inwardly-opening door and an extension adapted to extend outwardly away from the door frame, a latch comprising an arm having one end pivoted to the mounting plate extension, a flange extending outwardly from the opposite end of the arm at substantially right-angles thereto, and a tab on said arm disposed intermediate the hinged end thereof and the flange, said tab extending outwardly in the opposite direction from said flange substantially right-angles to the arm.

said latch being pivotal between a normal door-blocking position in which said arm lies adjacent said plate extension and said flange is disposed in the swing path of the door and a door-unblocking position in which said flange lies clear of the swing path of the door, and an intermediate position in which both the tab and the arm disposed in the swing path of the door, whereby in said intermediate position of latch the door may be cracked open until it engages both the tab and the arm, and a latch retainer comprising a flat strip having one end pivoted to said arm and means on another end for removably engaging between the door edge and the door frame for preventing pivotal movement of the latch from its door-blocking position.

* * * * *